United States Patent [19]

Oguchi et al.

[11] 4,284,700

[45] Aug. 18, 1981

[54] POLYMER COATED TRANSITION METAL POWDER AS ELECTROSTATIC IMAGE TONER

[75] Inventors: Toshihiko Oguchi, Kawasaki; Akio Ishizawa, Ichikawa; Hiromi Yoshida, Tokyo, all of Japan

[73] Assignee: Tokyo Shibaura Denki Kabushiki Kaisha, Tokyo, Japan

[21] Appl. No.: 105,275

[22] Filed: Dec. 19, 1979

Related U.S. Application Data

[63] Continuation of Ser. No. 875,682, Feb. 6, 1978.

[30] Foreign Application Priority Data

Feb. 4, 1977 [JP] Japan ..... 52-10771

[51] Int. Cl.[3] ..... G03G 9/08

[52] U.S. Cl. ..... 430/105; 430/107; 430/109; 430/137; 427/216; 427/221; 428/407

[58] Field of Search ..... 430/107, 108, 137, 109, 430/105; 427/216, 221; 428/407

[56] References Cited

U.S. PATENT DOCUMENTS

| | | | |
|---|---|---|---|
| 3,938,992 | 2/1976 | Jadwin | 430/107 X |
| 4,073,980 | 2/1978 | Westdale | 430/108 |

FOREIGN PATENT DOCUMENTS

| | | | |
|---|---|---|---|
| 630295 | 10/1961 | Canada | 430/107 |

*Primary Examiner*—John D. Welsh

*Attorney, Agent, or Firm*—Oblon, Fisher, Spivak, McClelland & Maier

[57] ABSTRACT

A coated powder comprising a transition metal or compound thereof prepared by the process which comprises coating the surface of a powdered transition metal or compound there with a free radical polymerizable monomer having an e value of (−)0.8 to (+)0.8 and then subjecting the resulting coated powder to free-radical polymerization conditions.

6 Claims, No Drawings

POLYMER COATED TRANSITION METAL POWDER AS ELECTROSTATIC IMAGE TONER

This is a continuation of application Ser. No. 875,682, filed Feb. 6, 1978.

BACKGROUND OF THE INVENTION

1. Field of the Invention

This invention relates to toners for electrostatic image development, particularly to a toner which can provide clear developed images over a long use cycle.

2. Description of the Prior Art

Generally, in electrophotography a colored resin powder, i.e., toner, is spread on a photosensitive plate or paper containing an electrostatically charged image. The toner particles image-wise adhere to the surface of the photosensitive plate or paper because of the electrostatically charged image. In this manner a visible image is developed on the plate or paper. The developer image may be transferred from the photosensitive plate on to a copy paper. The toner particles are thermally fused to the surface of the photosensitive paper or copy paper, thereby fixing the visible image on the paper.

The above technique is called the dry development method. In this method the toner is mixed with a carrier in order to electrically charge the toner to the degree necessary and spread the toner particles on the photosensitive plate or paper in uniform concentration. There are two dry development methods. One is called the cascade method in which a mixture of toner and a carrier such as glass particles, i.e., developing agent, is applied onto a photosensitive plate or paper. The other is called the magnetic brushing method in which a magnetic brush is used. The magnetic brush is comprised of a rod magnet to which the mixture of toner and carrier such as ferro magnetic particles, i.e., one of components in the developing agent, is attracted. The brush with the developing agent is so moved as to sweep the surface of a photosensitive plate or paper. During this sweeping process only the toner particles fall from the brush and stick to the surface of the photosensitive plate or paper.

In either dry development method, however, the surface of each carrier particle can never be free of toner particles since in the developing agent the toner particles adhere to the carrier particles. If not free of toner particles, the carrier fails to be charged electrically to the degree necessary, thus degrading the quality of the developed image. Further, in the magnetic brushing method toner particles will also adhere to those portions of the photosensitive plate or paper where no image has been electrostatically formed. If not free of extraneous toner particles, the photosensitive plate or paper degrade greatly the quality of the developed electrostatic image, particularly when it is repeatedly used and subjected to electrical charging, exposure, development and transfer many times.

Moreover, the toner contains a thermoplastic resin binder which melts or softens at a relatively low temperature. While being used or stored, the toner may therefore easily fuse together to form a massive block of material form agglomerates or the like depending upon the ambient temperature. If this happens, the toner loses its function as a powder toner.

A one component toner, that is one which does not contain carrier material, comprises in a single particle both the thermoplastic resin and magnetite powder. The attractive force of the magnetic brush for such powders is, of course, a function of the mass of magnetite powder in the toner particles. Thus such toner particles must contain a significant quantity of magnetite powder.

Accordingly, a need continues to exist for a toner having the proper balance of necessary properties.

SUMMARY OF THE INVENTION

An object of this invention is to provide a toner for electrostatic image development, which provides clear developed images over a long period of time, and a toner for use as a one or two component development agent.

Accordingly, an object of the present invention is to develop toner particles which do not adhere to the non-imaged portions of the photosensitive substrate.

Another object of the present invention is to provide toner particles which allow the repeated re-use of the photosensitive substrate to produce good quality copies.

These and other objects of the present invention have been obtained by toner particles comprising a transition metal-containing powder having a coating prepared from a free radical polymerizable monomer.

DETAILED DESCRIPTION OF PREFERRED EMBODIMENTS

The present invention provides novel image developers or toners which are particularly adapted to developing latent images. These image developers or toners comprise transition metal or transition metal compounds in powder form having an adherent coating prepared from a free radical polymerizable monomer. The free-radical polymerizable monomer is one having an "e" value of (−)0.8 to (+)0.8 which relate the relate reactivities of monomers under free-radical polymerization conditions. The "e" value of the monomer is preferably in the range of (−)0.4 to (+)0.6.

The "e" value of free radical polymerizable monomers is well-known. A discussion of the "e" value is found in the *Journal of Polymer Science,* 1947, page 101 and the *Journal of Polymer Science,* Volume 3, page 772, published 1948.

Typical monomers include Acrylic acid, Acrylic acid ester, Methacrylic acid, Methacrylic acid ester, Styrene, p-Chlorostyrene, o-Aminostyrene, Acrylamide, Acrylnitrile, Vinyl pyridine, Vinyl pyrrolidone, Vinyl oxide, and the like.

The transition powder may be a transition metal or a transition metal-containing compound such as Iron, Cobalt, Nickel, Zinc or Chromium; metal oxide powder such as Chromium oxide; a metalic sulfide powder such as Cadmium sulfide, Zinc sulfide, Selenium sulfide, Lead sulfide, or a metallic nitride powder such as Zinc nitride, Chromium nitride, Aluminum nitride, Boron nitride, Titanum nitride, Tantalum nitride. Particle size is preferably in the range of 0.1 to 3.0 $\mu$m.

The polymer may be easily bonded or coated on the surface of the transition metal or transition metal-containing compound powder to form an adherent coating. In a technique, the transition metal powder, the mixture of monomer with a solvent and water are mixed together with heating in the presence of a polymerization catalyst which produces the ion $HSO_3^-$, such as $H_2SO_3$, $NaHSO_3$, $NH_4HSO_3$. The resulting slurry may then be sprayed into a hot air flow to evaporate the solvent. The, thus, obtained dried powder is used as the toner for electrostatic image development.

To the polymerization catalyst may be added a persulfate (Vulcanization assistant) such as $K_2S_2O_8$ or peroxide group such as Benzoiloxideazobisisobutylonitrile, for promoting (activating) the polymerization reaction velocity.

The coated powders of the present invention have wide application as toners and image developers in the photocopy field. These coated powders may be utilized as the magnetic toner in one component developing systems, i.e., those wherein carrier particles are not employed. The coated powders also may be used as the toner in two component developing systems wherein a carrier is employed, for instance, iron powder in admixture with the coated powders of the present invention.

When the coated powders of the present invention are employed in a one component developing system the free-radical polymerizable monomer, such as butylacrylate, is coated onto the magnetic metal powder and subjected to free-radical polymerization. Preferably, the magnetic metal powder on which the monomer is coated possesses good color qualities such as iron oxide or ferrite. Alternatively, the coated powder so produced may be dispersed in a polymer, such as polyamide resin, to produce the toner. Preferably, the resulting dispersion contains at least 30 wt.% of the coated particles of this invention. The coated magnetic particles of this invention may be dispersed in the resin by conventional techniques. One method involves ball milling an admixture of the coated magnetic particles with the thermoplastic resin and a solvent to produce a slurry. The slurry may then be spray-dried in hot air to evaporate the solvent. A spherical toner having the proper particle size is obtained.

The toner obtained by this technique has excellent properties, good thermal flow characteristics, i.e., viscosity, the process of toner manufacture is easy, a homogenized toner is obtained containing the dispersion of the coated transition metal powder, the magnetic material micro-powder has very good stability, and control of electrification of the toner can be easily done by changing the monomer which is used to treat the surface of the transition metal micro powder.

It has been proposed to mechanically bond to conventional thermoplastic toners, metallic micro powders to inhibit blocking or agglomerating of such toners during storage. However, the strength of this mechanical bond is low, and as a result the micro particles often become detached from the toner leaving the surface of the thermoplastic resin exposed. As a result blocking or agglomeration of the toner particles occurs. The coated metallic micro powders of this invention may be used to treat the surfaces of conventional toners to inhibit the blocking or agglomerating thereof. Toner particles so treated are completely covered by a tightly adhering layer of the coated micro particles. It would appear that the bond between the thermoplastic toner and coated micro particles is not only a mechanical bond but also exhibits the properties of a strong chemical bond as well.

Having now fully described the invention, a more complete understanding can be obtained by reference to certain specific examples, which are included for purposes of illustration only and are not intended to be limiting unless otherwise specified.

EXAMPLE 1

50 parts by weight of magnetite particles having an average particle diameter of 0.3$\mu$, 105 parts by weight of water and 3 parts by weight of Butyl acrylate monomer were placed in a flask, to this was added 45 parts by weight of a Sulfurous acid containing 0.1 mols per liter while mixing and heating at a temperature of 50 degrees centigrade for two hours. The bonded Butyl acrylate polymer was bonded to the surface of magnetite powder by the polymerization reaction. The resulting product was recovered by decanting and evaporating the remaining water, and spray dried.

60 parts by weight of coated magnetite prepared above and 40 parts by weight of "Epicoat #1004" (epoxy resin, trademarked product) were blended in a conventional ball mill with 100 parts by weight of Acetone. The resulting mixture was spray dried using a rotary disc type atomizer. A toner body powder having a particle size of 5 to 10$\mu$ was obtained.

100 parts by weight of the thus obtained toner particle and 1 part by weight of the carbon black were mixed and fed into a fluid bed pulverizer of hot air flow-type which was maintained at 50° C. The surface of the toner body particles were covered by carbon layer to form a conductive surface on the toner.

Using the toner thus obtained as monocomponent developing agent, a negatively charged electrostatic image formed on a zinc oxide photosensitive surface was developed by the magnetic brushing method, and a number of position image copies were obtained, all of which were clean copies. The developed image formed on the developing paper by the toner was firmly fixed by thermal fixing process.

For comparison, a toner made in the same manner as above except using magnetite which did not contain a coating of polymerized butyl acrylate was used to develop a number of copies. As a result, a number of positive image copies were obtained, however, these copies were unclear, and particularly the thermal fixing property was very poor because the surface of the toner was rough. This roughness was because the dispersion of the powder is poor.

EXAMPLE 2

50 parts by weight of the Molybdenum sulfide having an average particle size of 1$\mu$ and 135 parts by weight of water, 3 parts by weight of the N,N-Diethylmetha acrylate, and 15 ml of the Sulfurous acid having a concentration of 0.2 mol/l were mixed for 2 hours and maintained at 50° C. The N,N-Diethylmethaacrylate monomer of the corresponding polymer molecules were bonded on the surface of the Molybdenum sulfide particle.

100 parts by weight of the toner body particles (comprising 90 parts by weight of Styreneacrylicacidbutyl co-polymer resin having melting point 120° C. and 10 parts by weight of carbon black, which are mixed, obtained the black colored toner particle having 5 to 10$\mu$ particle size by using a process of heating mixing kneading—micro size pulverizing—fractionationing) and 5 parts by weight of the coated Molybdenum sulfide micro powder prepared above, were mixed and fed into a fluid bed pulverized of hot air flow type which was maintained at 70° C. during about 40 minutes. A layer of the coated Molybdenum sulfide micro powder was formed on the surface of the toner body particles. Toner is one suitable for use in the two component developing process.

3 parts by weight of the above toner was mixed with 100 parts by weight of the 100$\mu$ Iron powder having an oxidized surface to yield a two component developing agent. Using this developing agent, a negatively charged electrostatic image formed on an organic photosensitive paper was developed by the magnetic brushing method, and a number of positive image copies were obtained, all of which were clear. The developing properties of this agent did not deteriorate even after 5,000 copies.

Further, this developing agent was stored in a tank maintained at 50° C., and a blocking test conducted. Even after one week at these conditions no blocking occurred. This proved that the toner had a good stability.

Further, instead of above-mentioned Molybdenum micro powder, other transition metal powder treated in same manner was used for surface treatment the toner body. Also in this case the resulting toner was proved to have a good storage stability. The same effect was obtained.

Having now fully described the invention, it will be apparent to one of ordinary skill in the art that many changes and modifications can be made thereto without departing from the spirit or scope of the invention as set forth herein.

What is claimed as new and intended to be covered by Letters Patent is:

1. A toner powder capable of developing permanent visible images from latent electrostatic images comprising a thermoplastic resin and a coated powder comprising a transition metal or compound thereof which is coated with a polymer made from a free radical polymerizable monomer having an E value of (−)0.8 to (+)0.8 by in situ polymerization.

2. The toner powder of claim 1 in which the transition metal compound is molybdenum sulfide.

3. The toner powder of claim 1 in which the transition metal compound is magnetite.

4. The toner powder of claim 1 in which the e value is (−)0.4 to (+)0.6.

5. A toner powder capable of developing permanent visible images from latent electrostatic images wherein the coated powder of claim 1 is dispersed in the thermoplastic resin.

6. The toner powder of claim 1, wherein said free radical polymerizable monomer is selected from the group consisting of acrylic acid, acrylic acid esters, methacrylic acid, methacrylic acid esters, styrene, p-chlorostyrene, o-aminostyrene, acrylamide, acrylnitrile, vinyl pyridine, vinyl pyrrolidine and vinyl oxide.

* * * * *